US005141464A

United States Patent [19]

Stern et al.

[11] Patent Number: 5,141,464

[45] Date of Patent: Aug. 25, 1992

[54] TOUCH RESPONSIVE ANIMATED TOY FIGURE

[75] Inventors: Howard R. Stern, Redondo Beach; Ronald MacBain; Ben Guerrero, both of Los Angeles, all of Calif.

[73] Assignee: Mattel, Inc., El Sequndo, Calif.

[21] Appl. No.: 644,814

[22] Filed: Jan. 23, 1991

[51] Int. Cl.[5] ..... A63H 3/36; A63H 11/00; A63H 3/02

[52] U.S. Cl. ..... 446/338; 446/353; 446/372; 446/395

[58] Field of Search ..... 446/340, 339, 338, 337, 446/330, 320, 304, 352, 353, 369, 370, 371, 372, 376, 384, 391, 395

[56] References Cited

U.S. PATENT DOCUMENTS

| | | | |
|---|---|---|---|
| 985,746 | 2/1911 | Lewis | 446/304 X |
| 1,486,101 | 3/1924 | Megorden | 446/337 X |
| 2,802,301 | 8/1957 | Lohr | 446/304 |
| 4,224,759 | 9/1980 | Saint-Pierre et al. | 446/304 X |
| 4,244,139 | 1/1981 | Erickson et al. | 446/304 |
| 4,561,854 | 12/1985 | Amici et al. | 446/304 |
| 4,669,997 | 6/1987 | Kulesza et al. | 446/304 X |
| 4,689,033 | 8/1987 | Droller et al. | 446/330 X |
| 4,778,433 | 10/1988 | McKay et al. | 446/339 X |
| 4,820,236 | 4/1989 | Berliner et al. | 446/369 |

FOREIGN PATENT DOCUMENTS

| | | | |
|---|---|---|---|
| 579409 | 9/1976 | Switzerland | 446/304 |
| 2040705 | 9/1980 | United Kingdom | 446/340 |
| 2199761 | 7/1988 | United Kingdom | 446/320 |

*Primary Examiner*—Robert A. Hafer
*Assistant Examiner*—D. Neal Muir
*Attorney, Agent, or Firm*—Roy A. Ekstrand

[57] ABSTRACT

A touch responsive animated toy figure is fabricated of a soft or plush material and supports an internal housing formed of a rigid plastic material or the like. A rigid head chassis is supported within the head portion of the plush figure and is pivotally secured to a neck extension of the internal body housing. A motor driven operative mechanism produces a pivotal motion of the figure's head for a predetermined time interval each time the motor is energized. A reciprocating tongue motion is provided in response to head motion to cause a tongue to be successively extended and withdrawn from the head portion of the figure during head motion. A sensor located on the outer portion of the plush figure is operatively coupled to the motor control causing the initiation of an operative cycle for a predetermined interval each time the sensor is touched or manipulated.

10 Claims, 3 Drawing Sheets

FIG. 3
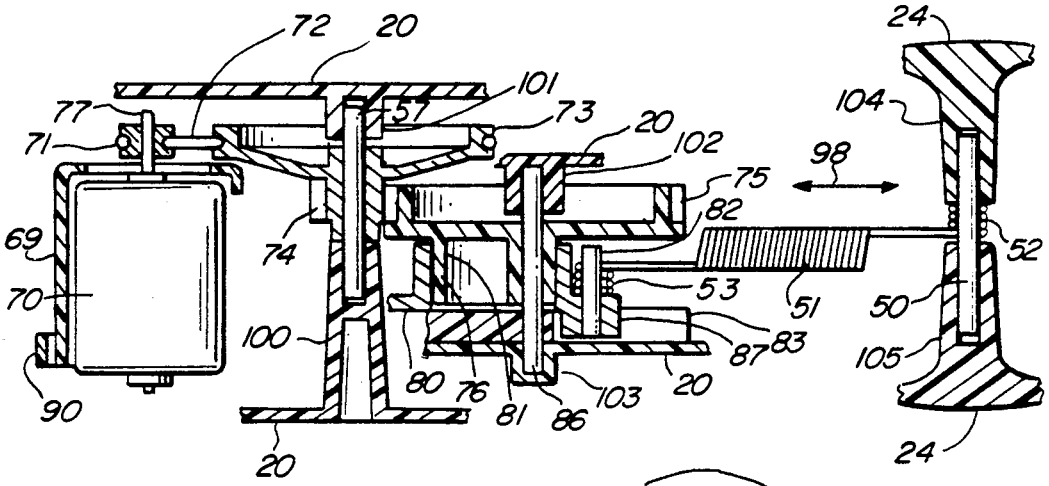
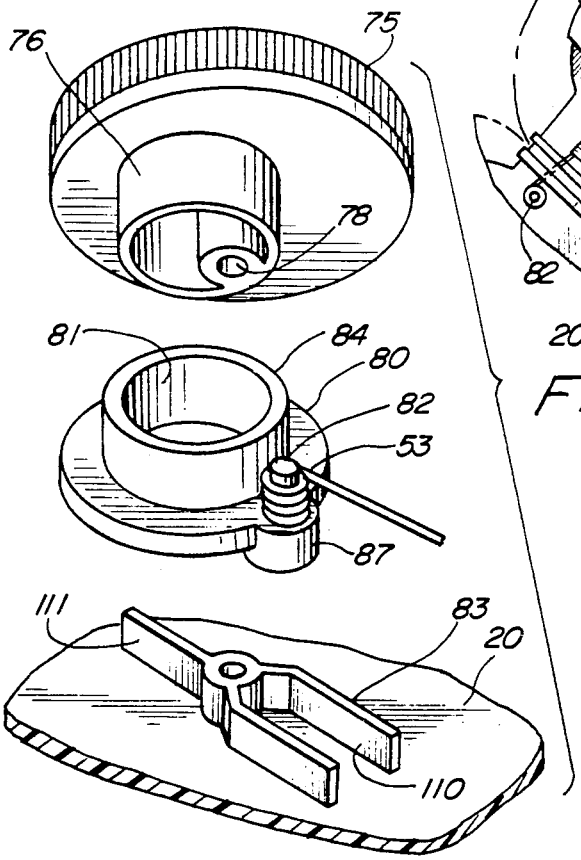
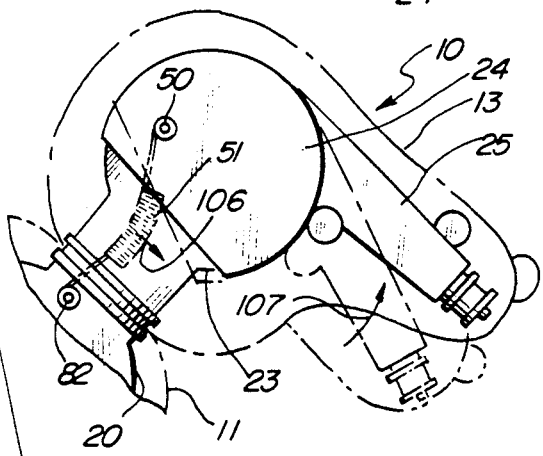
FIG. 4 FIG. 5

TOUCH RESPONSIVE ANIMATED TOY FIGURE

FIELD OF THE INVENTION

This invention relates generally to animated toy figures and particularly to those responsive to external stimulus.

BACKGROUND OF THE INVENTION

Through the years, a wide variety of toy figures and dolls have been created for entertainment and amusement. Such toy figures and dolls have assumed shapes replicating humans, human infants, animals, as well as fanciful characters. In their efforts to increase the amusement and play value of such toy figures and dolls, practitioners in the art have created a variety of toy figures and dolls having movable features and articulated bodies and limbs. In addition, such articulated and movable figures have been, in some instances, provided with motion energy sources such as wind up motors or battery driven electrical motors. A result has been to provide a variety of movable toy figures and dolls. Another improvement in the continuing efforts of practitioners in the art to provide increased amusement and play value has been found in the creation of toy figures and dolls which respond to external stimulus. Practitioners have, in such efforts, provided toy figures and dolls which respond to such external stimulus as sounds, touch or the contact with external articles such as baby bottles, simulated food articles and the like. Numerous examples of such movable and articulated as well as stimulus responsive toy figures and dolls are found in the art.

For example, U.S. Pat. No. 4,516,951 issued to Saigo, et al. sets forth a MOVABLE TOY ANIMAL in which an articulated toy animal body supports an internal electric motor and support frame together with operative means to provide motion of the head, eyes, ears and other portions of the toy figure.

U.S. Pat. No. 4,696,653 issued to McKeefery sets forth a SPEAKING TOY DOLL which responds with spoken words and/or sentences to touching of selected portions of the doll by the user. A simulated speech system within the toy figure includes prerecorded short messages which are played by the audio system in response to the various touch sensitive areas of the doll.

U.S. Pat. No. 4,813,908 issued to Oikawa, et al. sets forth a MOTION TOY HAVING ACTION CHANGING STRUCTURE in which a toy body includes a trunk having an internal housing therein, a head, as well as four supporting legs and feet. An electric motor system within the interior of the housing is operatively coupled to at least two of the legs and feet to provide motion of the toy figure.

U.S. Pat. No. 2,906,059 issued to Berger sets forth DOLL WITH SOUND ACTUATED MOVING PARTS having a body portion and legs pivotally secured thereto. Spring means within the body and legs urge the doll from a reclining to sitting position and electromagnetic means are operative to maintain the doll in a reclining position until a sound or touch sensitive means is actuated. Thereafter, the doll slowly rises from a reclining to a sitting position.

U.S. Pat. No. 3,274,729 issued to Refabert sets forth a DOLL HAVING PHOTOCELL-ACTUATED SOUNDING MEANS in which a doll includes motion means including an electric motor and operative linkage coupled to the doll's appendages is operated in response to incident light upon a photoconductive light sensor.

U.S. Pat. No. 4,333,262 issued to Kimura sets forth a SOLAR POWERED TOY having a plurality of legs with angularly related sections connected together. Certain of the sections are mounted for relative turning movement and electric motors powered by solar cells are mounted so as to turn adjacent sections of the legs. As a result, the movements of the legs of the design change in response to exposure of the solar cells to a light source.

U.S. Pat. No. 4,717,363 issued to Refabert sets forth DOLLS OR SIMILAR TOYS which are equipped with a voice or sound produced assembly adapted to emit sounds such as the crying sounds of a baby. The sound mechanism is controlled by an infrared radiation detector located upon the doll's skin which is sensitive to proximity of the user's body and responds thereto.

U.S. Pat. No. 4,840,602 issued to Rose sets forth a TALKING DOLL RESPONSIVE TO EXTERNAL SIGNAL in which a doll cooperates with a remote signal source to provide an interactive set of doll responsive speech and phrases. The doll includes a radio frequency receiver which receives encoded data from a remote signal source and which under the control of a central processing unit produces simulated audible responses in accordance with the received signals.

U.S. Pat. No. 344,922 issued to Rebentisch sets forth a MECHANICAL CLOCK in which a figure replicating a dog includes means articulating the head, tongue and tail portion of the doll in response to the occurrence of predetermined times. A clock system is coupled to a drive motor to control the timing of the occurrence of figure motion.

U.S. Pat. No. 1,577,903 issued to Gover, et al. sets forth a MECHANICALLY OPERATED FIGURE in which a figure representing a dog in a seated position includes an electrically operable motor driven head motion apparatus together with a source of light illumination.

U.S. Pat. No. 3,119,201 issued to Brown, et al. sets forth a TOY in which an animated toy simulates a snake, rope or the like and is supported within an enclosure. The enclosure opens in response to predetermined stimulus such as sound and causes the object to rapidly extend from the housing in a jack-in-the-box type activity.

U.S. Pat. No. 3,456,383 issued to Gardel, et al. sets forth ELECTRIC ARM AND HEAD MOVEMENT in which a doll includes an internal housing within a doll torso and movable head is coupled thereto. A motor drive mechanism within the torso is operatively coupled to the head and arms of the toy figure and provides motion in response thereto.

U.S. Pat. No. 3,660,932 issued to Raffeli, et al. sets forth a DEVICE FOR CONTROLLABLY CAUSING DOLL'S EYES AND TONGUES TO MOVE AN ELECTRIC CONTROL FOR SAID DEVICE in which a movable eye or tongue for a doll is provided on the outer surface of a hollow substantially hemispherical member rotatably attached to hollow supports in the doll's head. Electromagnetic means are provided to move the eye or tongue under the control of a multivibrator circuit.

U.S. Pat. No. 3,672,096 issued to Johmann sets forth DOLLS in which a doll replicating a human infant is provided with movable head, leg and arm appendages.

Motor drive means within the doll torso are operatively coupled to the appendages to provide motion thereof.

U.S. Pat. No. 3,754,351 issued to Glass, et al. sets forth a DOLL having a movable torso and related drive mechanism for driving the doll through stages of a functional mode of operation simulating pouring of a beverage and serving food. U.S. Pat. No. 3,834,071 issued to Terzian, et al. sets forth a DOLL WITH COORDINATED HEAD AND TORSO MOVEMENT in which a doll includes a lower torso portion and an upper torso portion rotatable thereto. A head is movably secured to the upper torso portion and a motor mechanism within the lower torso portion produces a to-and-fro twisting motion of the upper torso and head portions.

U.S. Pat. No. 4,699,603 issued to Saigo, et al. sets forth a TOY HAVING INDEPENDENT POWER FEEDER in which an electrically powered articulated figure cooperates with an external battery power source formed to replicate a nursing bottle. The insertion of the bottle nipple in a receptacle within the figure's mouth provides energy for the motion of the figure.

U.S. Pat. No. 4,828,526 issued to Schneider, et al. sets forth an ANIMATED TOY FIGURINE in which a toy figure and fluid actuated animation module are operated upon a toy figure assembly. The fluid module is pressurizable by deformation of predetermined parts of the fluid module to pressurize the moving mechanisms of the fluid system and articulate the figure.

While the foregoing described examples of prior art devices have provided increased amusement and play value for toy figures, there remains nevertheless a continuing need in the art for evermore improved animated toy figures.

SUMMARY OF THE INVENTION

Accordingly, it is a general object of the present invention to provide an improved articulated toy figure. It is a more particular object of the present invention to provide an improved touch responsive animated toy figure.

In accordance with the present invention, there is provided a toy figure comprises: a body portion having an outer surface and an interior body cavity therein; a head portion having an interior head cavity therein; a housing supported within the interior body cavity; a head chassis supported within the interior head cavity; pivot means pivotally supporting the head chassis with respect to the housing; a sensor supported proximate the outer surface of the body portion; an extendable tongue supported within the head chassis; and motion means for causing pivotal motion of the head chassis with respect to the housing and reciprocating motion of the tongue when the sensor is operated.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 3 sets forth a partial section view of the present invention animated toy figure taken along section lines 3—3 in FIG. 1;

FIG. 4 sets forth an assembly view of a portion of the present invention animated toy figure; and FIG. 5 sets forth a portion of the present invention animated toy figure in alternate positions.

DESCRIPTION OF THE PREFERRED EMBODIMENT

Figure 1:
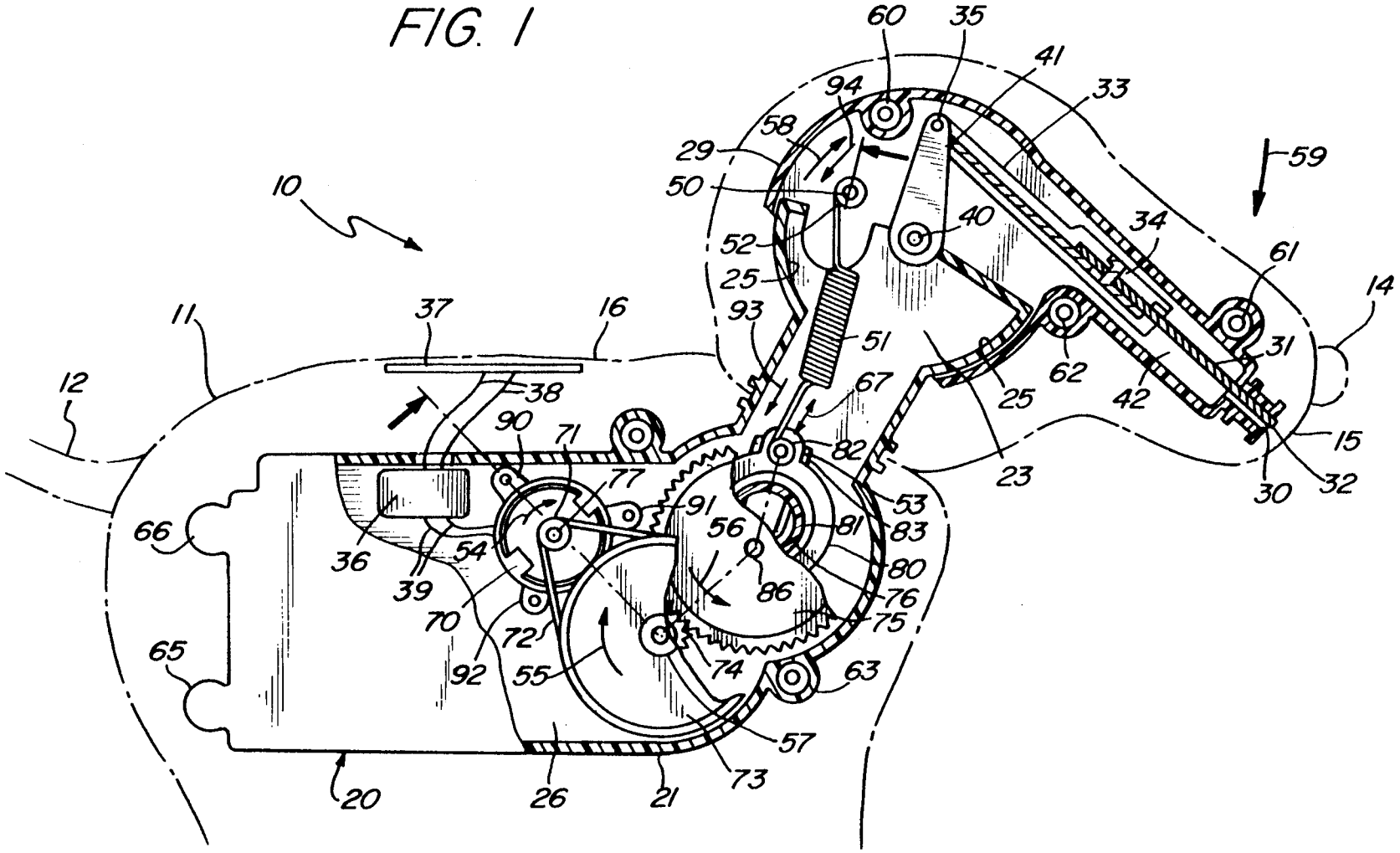
FIG. 1 sets forth a partial section view of an animated toy figure constructed in accordance with the present invention.

FIG. 1 sets forth a partially sectioned view of a toy figure constructed in accordance with the present invention and generally referenced by numeral 10. Toy FIG. 10 includes a plush body 11 which is configured to replicate a dog or similar animal. In its preferred form, body 11 is fabricated of a plush material having a soft somewhat resilient character and covered preferably by a soft fur or similar outer surface. Body 11 includes an extending tail 12, a head 13, a nose 14 and a mouth 15.

A rigid support housing 20, preferably formed of a molded plastic material or the like, defines an interior cavity 26 and a plurality of attachments 63, 64, 65 and 66. Attachments 63 through 66 are coupled to body 11 to maintain the position of housing 20 within body 11. Housing 20 further defines an upwardly extending head support 23 defining a semi-spherical surface 25 and a generally cylindrical neck portion 27. Spherical portion 25, neck portion 27 and head support 23 are rigidly joined to the remainder of housing 20 in a fixed rigid attachment. In its preferred form, housing 20, neck portion 27, head support 23 and spherical surface 25 are formed of a single integral molded plastic member. In addition, head support 23 further defines an elongated notch 85. A fixed arm 41 is secured to head support 23 in a fixed attachment and a pivot support 40 extends through the junction of the fixed arm 41 and head support 23. Fixed arm 41 further defines a pivot 35.

A head chassis 24, preferably formed of a molded plastic material, defines a generally spherical portion 29 and an elongated extending nose chassis 25. Nose chassis 25 terminates in a tongue aperture 30 and defines a hollow interior cavity 42. In accordance with an important aspect of the present invention, head chassis 24 is pivotally secured to pivot 40 and is rotatable about pivot 40. Spherical portion 29 is sized and configured to be received upon spherical surface 25 of head support 23 such that head chassis 24 is freely pivotable about pivot 40. A plurality of attachments 60, 61 and 62 extend from head chassis 24 and are coupled to head portion 13 of body 11. Thus, head portion 13 of body 11 is secured to head chassis 24 while housing 20 is secured to body 11. An elongated flexible generally planar tongue 31 defines an end 32 extending outwardly from nose chassis 25 through tongue aperture 30. The remaining end of tongue 31 is coupled to an elongated rigid tongue link 33 by a tongue attachment 34. The remaining end of tongue link 33 is pivotally secured to pivot 35 of fixed arm 41.

A sensor 37 constructed in accordance with conventional fabrication techniques is supported within body 11 just below the surface of back 16. A pair of wires 38 couple sensor 37 to a conventional motor control 36. An motor 54 constructed in accordance with conventional fabrication techniques is secured to housing 20 by a plurality of mounting tabs 90, 91 and 92. In further accordance with convention fabrication techniques, motor 70 includes an output shaft 77 coupled to drive pulley 71. A driven pulley 73 is rotatably secured to housing 20 by a post 57. A drive belt 72 is coupled between drive pulley 71 and driven pulley 73 such that rotation of output shaft 77 produces a corresponding rotation of driven pulley 73. As is better seen in FIG. 3, driven pulley 73 further includes a gear 74 concentric about post 57. Gear 74 is secured to driven pulley 73 such that rotation of driven pulley 73 produces a corresponding rotation of gear 74. An eccentric gear 75 is pivotally secured to housing 20 by a post 86. Eccentric gear 75 engages gear 74 such that rotation of gear 74 produces a corresponding rotation of eccentric gear 75. As is better seen in FIGS. 3 and 4, eccentric gear 75 further defines a cylindrical offset eccentric lobe 76. Lobe 76 is offset from post 86 and thus rotates in an offset or eccentric manner during the rotation of eccentric gear 75. An eccentric follower 80, the structure of which is better seen in FIG. 4 includes a cylindrical recess 81 and an upwardly extending post 82. As is also better seen in FIG. 4, eccentric follower 80 further includes a downwardly extending slide 87 which is generally concentric with post 82. A guide 83, the structure of which is better seen in FIG. 4, extends inwardly from housing 20 beneath eccentric follower 80 and receives slide 87. A coiled spring 51 includes a spring end 52 pivotally secured to post 50 of head chassis 24 and a spring end 53 pivotally secured to post 82 of eccentric follower 80.

In operation, a pressure or petting action against back 16 is sensed by sensor 37 to produce a signal which is coupled to motor control 36. Upon the activation of sensor 37, motor control 36 responds to the signal applied to energize electric motor 70 to produce a rotation of output shaft 77 and drive pulley 71 in the direction indicated by arrow 54. Because of the coupling between drive pulley 71 and driven pulley 73 provided by belt 72, driven pulley 73 is correspondingly rotated in the direction indicated by arrow 55. As driven pulley 73 rotates, the gear coupling between gear 74 and eccentric gear 75 causes eccentric gear 75 to rotate in the direction indicated by arrow 56. As eccentric gear 75 rotates, eccentric lobe 76 is rotated about post 86 in an eccentric manner which, because of the extension of lobe 76 into recess 81, causes eccentric follower 80 to be moved about post 86 in a manner similar to a arm and crank motion. Because slide 87 is slidably movable within guide 83, the rotation of eccentric gear 75 and the arm and crank action of eccentric follower 80 causes slide 87 to move within guide 83 in an reciprocating manner indicated by arrow 67. The reciprocating motion of slide 87 thus produced is coupled to spring 51 by the attachment of post 82 to spring end 53.

Spring 51 functions as a connecting arm between post 82 and post 50 of head chassis 24. Thus, as spring 51 undergoes reciprocating motion in the directions indicated by arrow 67, a corresponding rotation of head chassis 24 about pivot 40 is produced.

In the position shown in FIG. 1, motor 70, driven pulley 73, eccentric gear 75 and eccentric follower 80 have cooperated to move slide 87 within guide 83 to its maximum travel toward head chassis 24. Correspondingly, the coupling of spring 51 between slide 87 and post 50 have caused a corresponding pivotal motion of head chassis 24 about pivot 40 in the direction indicated by arrow 58. This pivotal motion produces a downward motion of nose chassis 25 in the direction indicated by arrow 59. In accordance with an important aspect of the present invention, it should be noted that arm 41 is fixed with respect to head support 23. Thus, as head chassis 24 is moved due to the above-described operative mechanism, the relative distance between pivot 35 of tongue link 33 and tongue aperture 30 is maximized. As a result and as is seen in FIG. 1, tongue 31 is completely withdrawn to the interior of nose chassis 25 such that end 32 is positioned within tongue aperture 30.

As motor 70 continues to operate and rotate output shaft 77 and drive pulley 71 in the direction indicated by arrow 54, driven pulley 73 continues to rotate in the direction indicated by arrow 55 which in turn continues the rotation of eccentric gear 75 in the direction indicated by arrow 56. Because of the above-described eccentric position of eccentric lobe 76, the continued rotation of eccentric gear 75 in the direction indicated by arrow 56 moves slide 87 within guide 83 away from head chassis 24 in the direction indicated by arrow 93.

As the rotation of motor 70, driven pulley 73 and eccentric gear 75 continues, eccentric lobe 76 moves eccentric follower 80 away from head chassis 24. The motion of slide 87 away from head chassis 24 in the direction indicated by arrow 93 is coupled by spring 51 to head chassis 24 causing head chassis 24 to pivot in the direction indicated by arrow 94. This reversed motion of head chassis 24 continues as motor 70 continues to turn until toy FIG. 10 assumes the position shown in FIG. 2.

Figure 2:
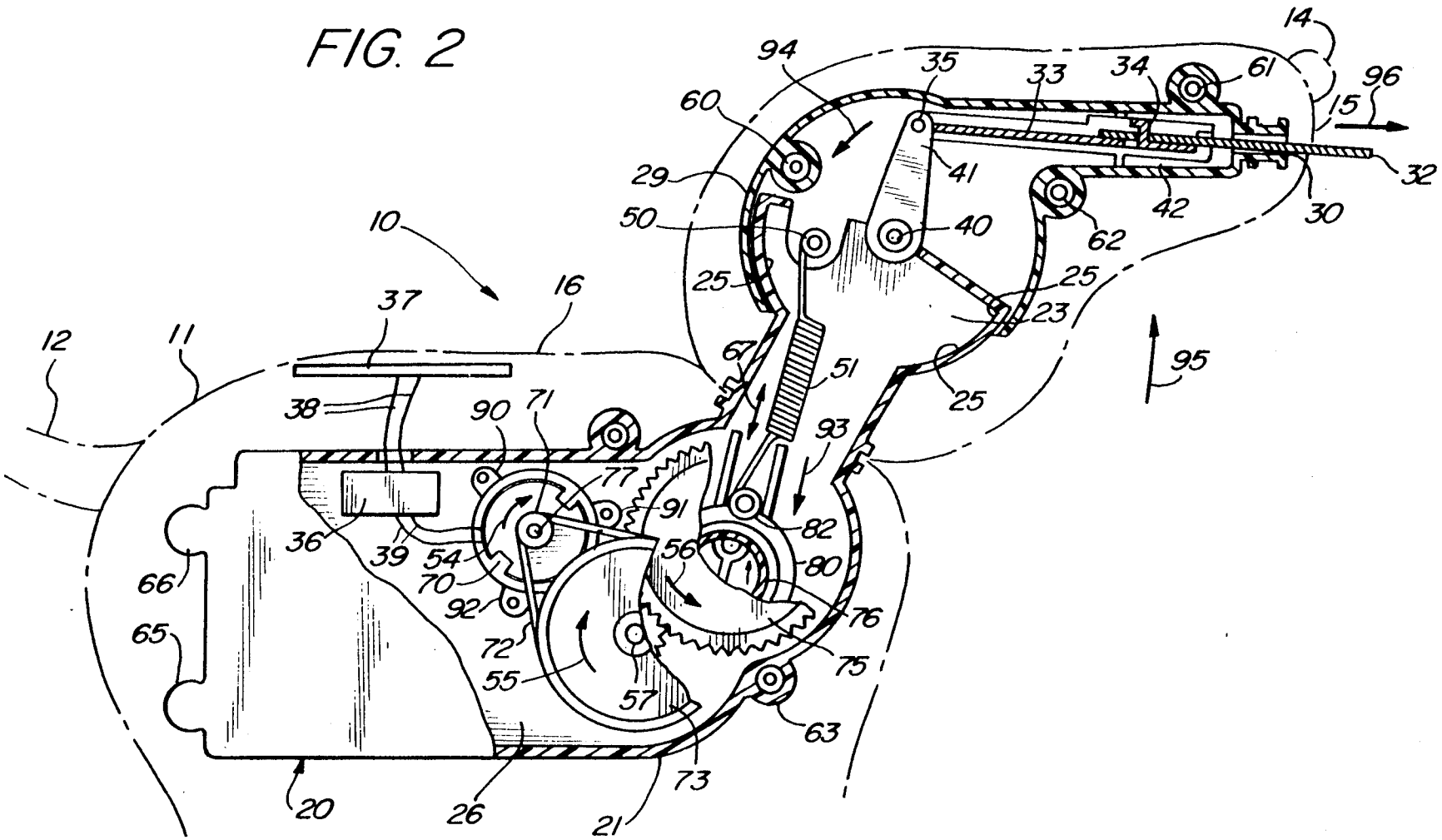
FIG. 2 sets forth a partial section view of the animated toy figure of FIG. 1 in an alternate position.

FIG. 2 sets forth toy FIG. 10 at the opposite extreme position of motion to that shown in FIG. 1. In all other respects, the structure in FIG. 2 is identical to FIG. 1 and the descriptions thereof apply equally well to the structure of FIG. 2. As can be seen by examination of FIG. 2, the rotation of motor 70 in the direction indicated by arrow 54 produces the above-described rotations of driven pulley 73 and eccentric gear 75 in the directions indicated by arrows 55 and 56 respectively. In accordance with the invention, the rotation of eccentric gear 75 and the cooperation of eccentric lobe 76, recess 81 and eccentric follower 80 have moved slide 87 within guide 83 to the position shown in FIG. 2. Thus, as slide 87 moves in the direction indicated by arrow 93, a drawing force is coupled by spring 51 to post 50 of head chassis 24 causing pivotal motion of head chassis 24 in the direction indicated by arrow 94. The pivotal motion of head chassis 24 in turn produces the upward motion of nose chassis 25 in the direction indicated by arrow 95.

In accordance with an important aspect of the present invention, it should be recalled that arm 41 is fixed with respect to head support 23. Thus, the above-described pivotal motion of head chassis 24 moves head chassis 24 with respect to pivot 35 of fixed arm 40. As can be seen by comparison of FIGS. 1 and 2, the pivotal motion of head chassis 24 in the direction indicated by arrow 95 moves tongue aperture 30 of nose chassis 25 closer to pivot 35. Because the length of tongue 31 and tongue link 33 remains unchanged during head chassis motion, this change in position moves nose chassis 25 inwardly upon tongue 31 causing end 32 of tongue 31 to extend outwardly through tongue aperture 30 in the direction indicated by arrow 96. Because mouth aperture 15 is aligned with tongue aperture 30, the extension of end 32 passes outwardly through mouth aperture 15. As a result, tongue 31 appears to have extended outwardly in the direction indicated by arrow 96.

As motor 70 continues to turn, the above-described motion takes place causing head 13 of toy FIG. 10 to move back and forth between the positions shown in FIGS. 1 and 2. During such motion, tongue 31 is repeatedly withdrawn into head 13 and extended outwardly therefrom through mouth aperture 15. As a result, toy FIG. 10 replicates or mimics the licking action of a dog or similar animal with the pivotal head motion and tongue extension and withdrawal characteristic thereof. In accordance with the preferred operation of the present invention, motor control 36 includes a conventional timing circuit operative each time sensor 37 is energized to cause motor 70 to operate for a predetermined time interval and thereafter interrupt motor operation until the next manipulation of sensor 37. As a result, toy FIG. 10 responds each time back portion 16 of body 11 is stroked or petted or otherwise manipulated to energize sensor 37 to cause the above-described head motion and licking action in a realistic response typical of dogs or similar animals.

FIG. 3 sets forth a partial section view of toy FIG. 10 taken along section lines 3—3 in FIG. 1. Housing 20 defines a downwardly extending boss 101 and an upwardly extending boss 100. A post 57 is received within boss 101 and boss 100 and captivated therebetween. Housing 20 further defines a boss 102 and a boss 103 having captivated therebetween a post 86. In addition, as referred to above, housing 20 further defines a guide 83, the structure of which is better seen in FIG. 4 extending upwardly from the interior surface of housing 20. Similarly, head chassis 24 defines a downwardly extending boss 104 and an upwardly extending boss 105. A post 50 is captivated within bosses 104 and 105.

An electric motor 70 is supported within a motor housing 69 having a plurality of outwardly extending support tabs (seen in FIG. 1) which include tab 90. Motor 70 includes a rotatable output shaft 77 having a drive pulley 71 secured thereto. A driven pulley 73 is rotatably supported by post 57 between bosses 100 and 101 and is operatively coupled to drive pulley 71 by a drive belt 72. Driven pulley 73 further defines a gear 74. An eccentric gear 75 is rotatably supported upon post 86 between bosses 102 and 103. Eccentric gear 75 engages gear 74 in the above-described operative coupling. Eccentric gear 75 further defines a downwardly extending cylindrical eccentric lobe 76. As can be seen, eccentric lobe 76 is offset or eccentric from post 86. An eccentric follower 80, the structure of which is better seen in FIG. 4, defines a cylindrical recess 81 which receives eccentric lobe 76. Eccentric follower 80 further defines a downwardly extending cylindrical slide 87 and an upwardly extending post 82. Slide 87 is received within guide 83 in the manner better seen in FIG. 4. A coil spring 51 has a spring end 53 coupled to post 82 and a spring end 52 coupled to post 50.

In operation and in accordance with the operation described above, rotation of motor 70 causes a corresponding rotation of drive pulley 71 which in turn rotates driven pulley 73. The rotation of driven pulley 73 causes an opposite direction rotation of eccentric gear 75. The rotation of eccentric gear 75 rotates eccentric lobe 76 about post 86 in an offset or eccentric manner. In response to the eccentric motion of lobe 76, eccentric follower 80 moves back and forth with respect to post 86 causing slide 87 to move in a reciprocating manner within guide 83. The reciprocating motion of slide 87 is coupled to spring 51 by post 82 which in turn causes a reciprocating motion of head chassis 24 due to the coupling of spring 51 to post 50 and bosses 104 and 105. Thus, as motor 70 is energized, spring 51 and head chassis 24 undergo a reciprocating motion in the direction indicated by arrows 98.

FIG. 4 sets forth a partial assembly view of eccentric gear 75, eccentric follower 80 and guide 83. Eccentric gear 75 includes a downwardly extending generally cylindrical eccentric lobe 76. Eccentric gear 75 defines a center aperture 78. As can be seen, eccentric lobe 76 is offset with respect to aperture 78 and the center line of eccentric gear 75 and thus produces the above eccentric rotational motion. Eccentric follower 80 defines a generally disk-like member having an upwardly extending recess wall 84 defining therein a cylindrical recess 81. Recess 81 receives eccentric lobe 76 in the above-described assembly. Eccentric follower 80 further includes a cylindrical downwardly extending slide 87 and an upwardly extending post 82. A spring end 53 of spring 51 (seen in FIG. 3) is pivotally secured to post 82). Housing 20 defines an upwardly extending guide 83 having formed therein an elongated channel 110 and an outwardly extending web 111. In the assembled position described above, slide 87 is received within channel 110 of guide 83 and eccentric follower 80 rests upon guide 83. Web 111 helps to support eccentric follower 80 during certain portions of the above described reciprocating motion thereof.

FIG. 5 sets forth a partial view of toy FIG. 10 which demonstrates a protective feature of the present invention structure. The mechanism described thus far has been shown and described in accordance with its normal operation in which the motion of head portion 13 results solely from the energizing of motor 70 (seen in FIG. 1). In accordance with an important aspect of the present invention, however, the use of spring 51 for a coupling link between head chassis 24 and eccentric follower 80 provides a protective feature in the event an attempt is made to move head 13 with respect to body 11 without energizing motor 70. But for the use of spring 51, such attempts at head motion could possibly damage the above-described drive mechanism and possibly disable it. Accordingly, head 13 is supported upon body 11 by head support 23, head chassis 24 and housing 20. For purposes of illustration spring 51, post 50 and post 82 are shown in dashed line representation. Thus, in the event a pivotal force is applied to head 13 in the direction indicated by arrow 107, head chassis 24 is pivoted with respect to head 23 in a corresponding manner. As a result, a compressive force is applied between post 50 and post 82. This compressive force causes spring 51 to bend or buckle having its center portion move outwardly in the direction indicated by arrow 106 and permitting head 13 to be pivoted without damaging the remaining structure. Once the external pivoting force is removed, the spring action of spring 51 causes head 13 to return to its normal position. Conversely, in the event attempt is made to pivot head 13 with respect to body 11 in the direction opposite to arrow 107, spring 51 is stretched or expanded to accommodate such pivotal motion and, once again, damage to the components within toy FIG. 10 may be avoided.

What has been shown is a new and improved toy figure having a touch responsive operative mechanism which realistically replicates the head motion and licking actions of a dog or similar animal.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy figure comprising:

a body portion having an outer surface and an interior body cavity therein;

a head portion having an interior head cavity therein;

a housing supported within said interior body cavity;

a head chassis supported within said interior head cavity;

pivot means pivotally supporting said head chassis with respect to said housing;

a sensor supported proximate said outer surface of said body portion;

a tongue supported in a fixed attachment to said housing held angularly deflectable with respect to said housing within said head chassis; and motion means for causing pivotal motion of said head chassis with respect to said housing when said sensor is operated between a first position in which said tongue is generally enclosed within said head portion and a second position in which a portion of said tongue extends generally from said head portion as said tongue angularly deflects with said pivotal motion.

2. A toy figure as set forth in claim 1 wherein said housing includes a head support extending from said body portion to said head portion and wherein said pivot means include a pivotal attachment between said head support and said head chassis.

3. A toy figure as set forth in claim 2 wherein said head portion defines a mouth aperture and wherein said tongue defines a first end secured to said head support and a second end extending through said mouth aperture during head motion.

4. A toy figure as set forth in claim 3 wherein said head support includes a fixed arm fixedly secured to said head support and wherein said first end of said tongue is coupled to said fixed arm.

5. A toy figure as set forth in claim 4 wherein said head chassis includes a tongue guide receiving and slidably supporting said second end of said tongue.

6. A toy figure as set forth in claim 5 wherein said tongue includes a rigid tongue link having a first end pivotally secured to said fixed arm and a second end attached to said first end of said tongue.

7. A toy figure as set forth in claim 6 wherein said motion means includes a motor producing rotational motion, crank means converting said rotational motion to reciprocating motion, and a connecting link coupled between said crank means and said head chassis to pivot said head portion through a limited angle of motion.

8. A toy figure as set forth in claim 7 wherein said motion means includes a motor and a motor controller responsive to said sensor to energize said motor for a predetermined time interval.

9. A toy figure as set forth in claim 8 wherein said connecting link includes a coil spring.

10. A toy figure as set forth in claim 1 wherein said motion means includes a flexible drive link coupled to said head chassis, said flexible drive link flexing when said head chassis is forced toward pivotal motion by an external force*.

* * * * *